US005147182A

United States Patent [19]

Timmons

[11] Patent Number: 5,147,182

[45] Date of Patent: Sep. 15, 1992

[54] INTEGRATED VACUUM PRESSURE SYSTEM FOR A BLADDER PUMP

[76] Inventor: Robert D. Timmons, S 9061, Meadowdale Rd., Prairie Du Sac, Wis. 53578

[21] Appl. No.: 599,011

[22] Filed: Oct. 17, 1990

[51] Int. Cl.[5] ..... F04B 21/00; F04B 43/10

[52] U.S. Cl. ..... 417/234; 417/394

[58] Field of Search ..... 417/234, 394; 280/47.33

[56] References Cited

U.S. PATENT DOCUMENTS

| | | | |
|---|---|---|---|
| 1,756,806 | 4/1930 | Beach | 417/234 |
| 2,122,991 | 7/1938 | Polston . | |
| 2,253,193 | 8/1941 | Niessen . | |
| 2,366,654 | 1/1945 | Rotter et al. . | |
| 2,384,174 | 9/1945 | Jones . | |
| 3,027,849 | 4/1962 | Zillman | 417/394 |
| 3,315,611 | 4/1967 | Thompson . | |
| 3,993,268 | 11/1976 | Moore . | |
| 4,111,613 | 9/1978 | Sperry | 417/394 |
| 4,135,860 | 1/1979 | Van Nederkassel . | |
| 4,149,827 | 4/1979 | Hofmann, Jr. . | |
| 4,178,133 | 12/1979 | Rawicki | 417/394 |
| 4,227,862 | 10/1980 | Andrew et al. . | |
| 4,424,999 | 1/1984 | Commins . | |
| 4,466,777 | 8/1984 | Kimberlin . | |
| 4,632,157 | 12/1986 | Bunkofske . | |
| 4,740,008 | 4/1988 | Johnson | 280/47.33 |
| 4,759,560 | 7/1988 | Virgulti . | |
| 4,789,180 | 12/1988 | Bell | 280/47.33 |
| 4,886,432 | 12/1989 | Kimberlin . | |

FOREIGN PATENT DOCUMENTS

| | | | |
|---|---|---|---|
| 688098 | 6/1951 | United Kingdom | 417/234 |

OTHER PUBLICATIONS

Timco Mfg. Inc, Geotechnical Well Products, Copyright 1989 p. 16.

*Primary Examiner*—Richard A. Bertsch
*Assistant Examiner*—Alfred Basichas

[57] ABSTRACT

An apparatus for driving a sampling pump disposed in a monitoring well comprises a structural support member including a container for pressurized gas; a platform having a top surface and supported by the structural member; an air compressor secured on the top surface and operably connected to the container; a venturi for generating a vacuum from the pressurized gas in the container; an engine for driving the air compressor; and a controller operably connected to the container, the generating means and the sampling pump for alternately directing compressed air and vacuum to the pump to thereby operate the pump.

20 Claims, 5 Drawing Sheets

INTEGRATED VACUUM PRESSURE SYSTEM FOR A BLADDER PUMP

FIELD OF THE INVENTION

The present invention relates generally to an apparatus for generating pressurized gas and vacuum for driving a liquid sampling pump disposed in a well, and specifically to an engine- or battery-powered air compressor for generating compressed air or vacuum to operate a bladder pump disposed in a well.

BACKGROUND OF THE INVENTION

A bladder pump is used to obtain water samples from ground monitoring wells. It may also be used for pumping hydrocarbons or other relatively low density liquids from an underground environment in which such liquids overlie and float upon the water in a water saturated formation. The pump is also used for recovering a representative water sample from beneath a floating layer of contaminant. An example of a pump of this type is disclosed in U.S. Pat. No. 4,886,432, issued to Kimberlin. This type of pump is driven by compressed gas and vacuum that are alternately supplied to the pump. Because this type of pump might be used in remote locations, there is, therefore, a need to provide a portable source of compressed gas and vacuum.

OBJECTS AND SUMMARY OF THE INVENTION

It is therefore an object of the present invention to provide a portable source of compressed gas and vacuum for driving a bladder pump in the field.

It is another object of the present invention to provide a compact assembly for providing a source of compressed gas and vacuum in the field that can be easily transported to the site.

It is still another object of the present invention to provide a portable source of compressed gas and vacuum that is appropriately controlled such that pressurized gas and vacuum are alternately supplied at predetermined periods to a bladder pump.

It is a further object of the present invention to provide a source of compressed gas and vacuum to operate a bladder pump disposed in a well with little head of water over the pump.

It is another object of the present invention to provide a controller for a source of compressed gas and vacuum that can be used in hazardous (flammable or explosive) environments without special protective enclosures.

It is yet another object of the present invention to provide a source of compressed gas and vacuum that uses a single air compressor to operate a bladder pump.

It is an object of the present invention to provide a portable source of pressurized gas and vacuum that utilizes a battery-operated piston/cylinder compressor wherein the suction cycle of the compressor is used to create the vacuum.

It is still a further object of the present invention to provide a portable source of compressed gas and vacuum that is disposed on a portable cart that can be moved around conveniently.

It is yet another object of the present invention to provide a cart for a gas compressor assembly wherein a storage tank for compressed gas is used as the main structural frame of the cart.

It is another object of the present invention to provide a controller for a compressor assembly for providing pressurized gas and vacuum to the bladder pump, in which electric or pneumatic valves are used to switch between pressurized gas and vacuum.

These and other objects of the present invention will become apparent from the following detailed description.

DETAILED DESCRIPTION OF THE INVENTION

Figure 1:
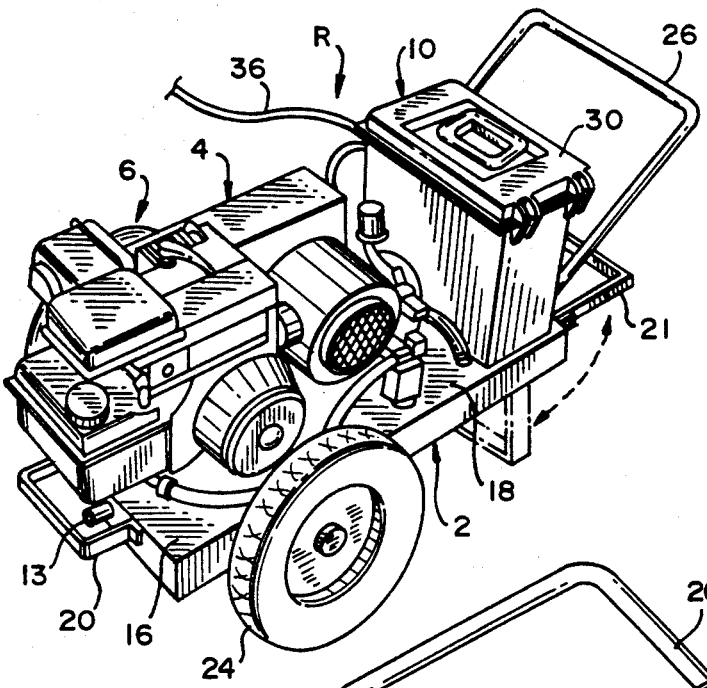
FIG. 1 is a perspective view of an integrated pressure vacuum system in accordance with the present invention.

An embodiment of the present invention is disclosed as an integrated pressure vacuum assembly R, as best shown in FIG. 1. The assembly R comprises a cart 2, an air compressor 4, an engine 6 and a controller 10.

Figure 2:
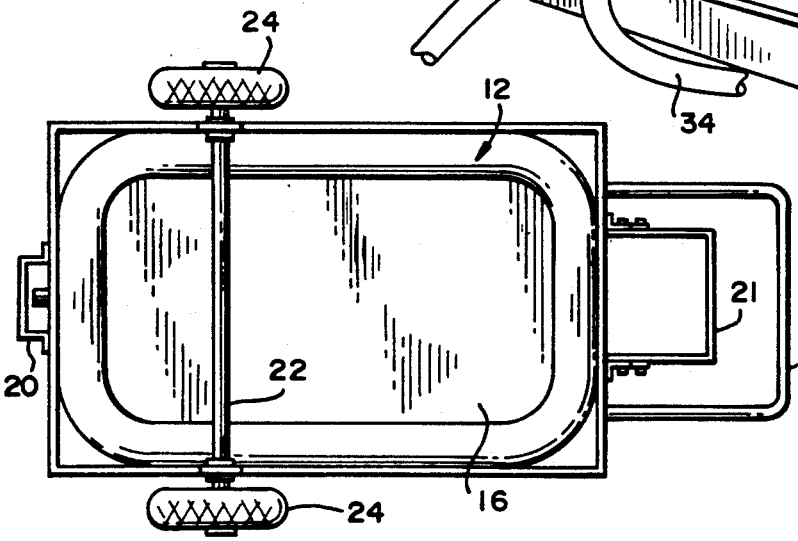
FIG. 2 is a bottom plan view of FIG. 1, showing a structural member used as a storage tank for compressed gas in accordance with the present invention.

The cart 2 has a structural, tubular support member 12, as best shown in FIG. 2. The interior volume of the support member 12 provides a storage means for the compressed air generated by the compressor 4. The support member 12 is appropriately shaped to provide adequate support for a platform 16 disposed on top of it. The support member 12 is shown in a shape of a rectangle thereby to provide lateral support to the platform 16. A bleeder valve 13 is operably secured to the support member 12.

The support member 12 is a single piece, unitary structural pipe, preferably Schedule 40 steel, for providing a strong and rigid framework for the cart 2 and an airtight reservoir with sufficient capacity for pressurized air. The member 12 is appropriately bent such that it forms a rectangle disposed along the longitudinal axis of the platform 16. The length of the member 12 is chosen such that sufficient interior volume is provided for the pressurized air and that an adequate framework is formed.

A person skilled in the art will appreciate that it is advantageous to use a reservoir for pressurized gas when operating a device from it in order to smooth out any pressure fluctuations from a compressor. Also, the use of a reservoir permits the compressor to only operate intermittently, thereby preventing unnecessary wear and tear.

The platform 16 provides a substantially flat surface 18 on which the air compressor 4, the engine 6 and the controller 10 are mounted. A fixed handle 20 is disposed at one end of the platform 16. A U-shaped bracket 21 is pivotally secured to the other end of the platform 16. The bracket 21 is selectively lockable in a support leg position, as best shown in dashed lines in FIG. 1, to support the other end of the platform 16 such that the platform 16 is disposed substantially horizontally during normal operation, thereby providing stability to the platform 16. The bracket 21 is also selectively lockable in a lifting handle position to provide a convenient means for lifting the assembly R, as best shown in FIG. 1.

An axle 22 and a pair of wheels 24 rotatably mounted to respective ends of the axle 22 are operably connected to the support member 12, as best shown in FIG. 2.

A removable handle 26 is operably secured to the platform 16 to provide a convenient means for moving the assembly around while the bracket 21 is in the support leg position. The handle 26 and the wheels 24 are easily removable such that the assembly R can be used as a portable unit or as a truck mounted unit.

The compressor 4 is secured to the platform 16 by conventional means (not shown). The output of the air compressor 4 is operably connected to interior of the support member 12 such that it functions as a storage tank for the compressed air. The gasoline powered engine 6 is mounted on the platform 16 by conventional means (not shown) and its output is operably connected to the compressor 4 to thereby drive it.

Figure 5:
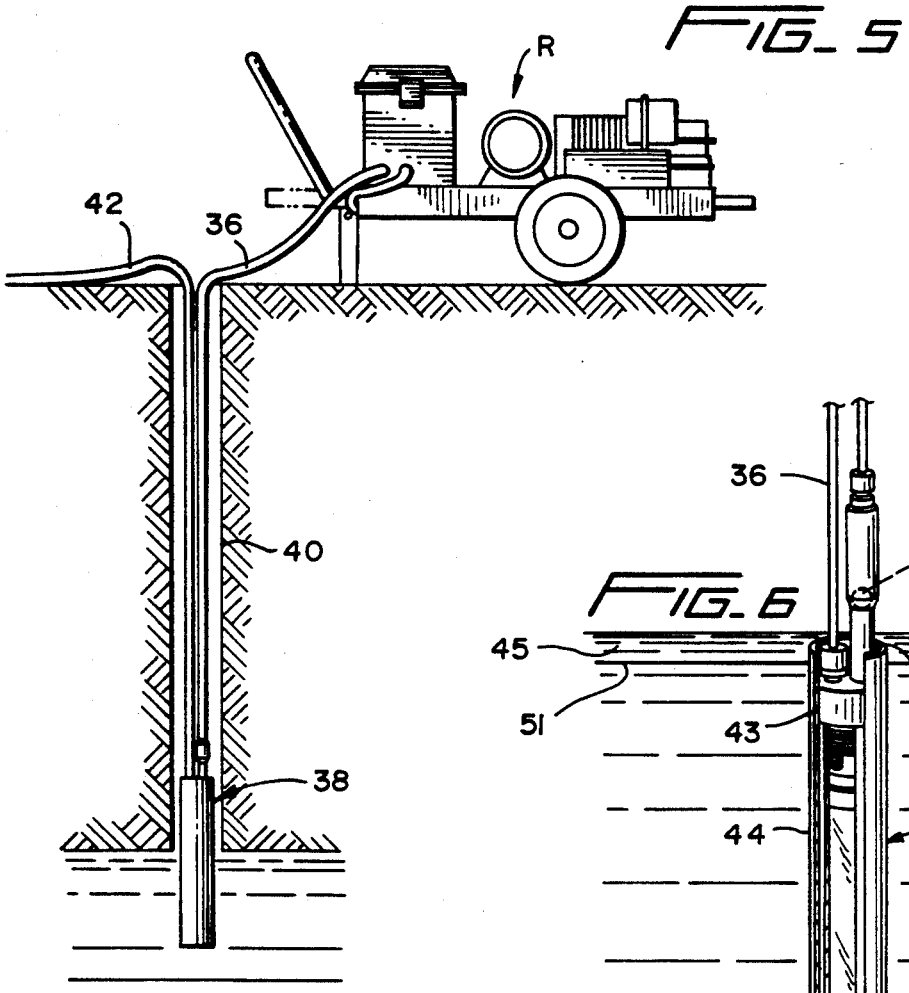
FIG. 5 is a side elevational view of an integrated pressure/vacuum system according to the present invention, shown connected to a bladder pump disposed in a well.

The controller 10 includes a housing 28 with a hinge-connected cover 30 for access. A removable tray 32, disposed within the housing 28, provides means for storing tools, spare parts, etc. A flexible hose 34 operably connects the controller 10 to the compressed air within the support member 12. A hose 36 connects to a bladder pump 38 disposed inside a well 40, as best shown in FIG. 5. The controller 10 provides compressed air or vacuum to the pump 38 through hose 36 in a preselected timed manner which will be described below.

The assembly R is shown connected to the bladder pump 38, as best shown in FIG. 5. The bladder pump 38 is used to take a representative sample from a monitoring well 40 to a collection container (not shown) through the hose 42. It employs a closed collection system that eliminates agitation and air or gas contact with the sample, ensuring sample integrity.

Figure 6:
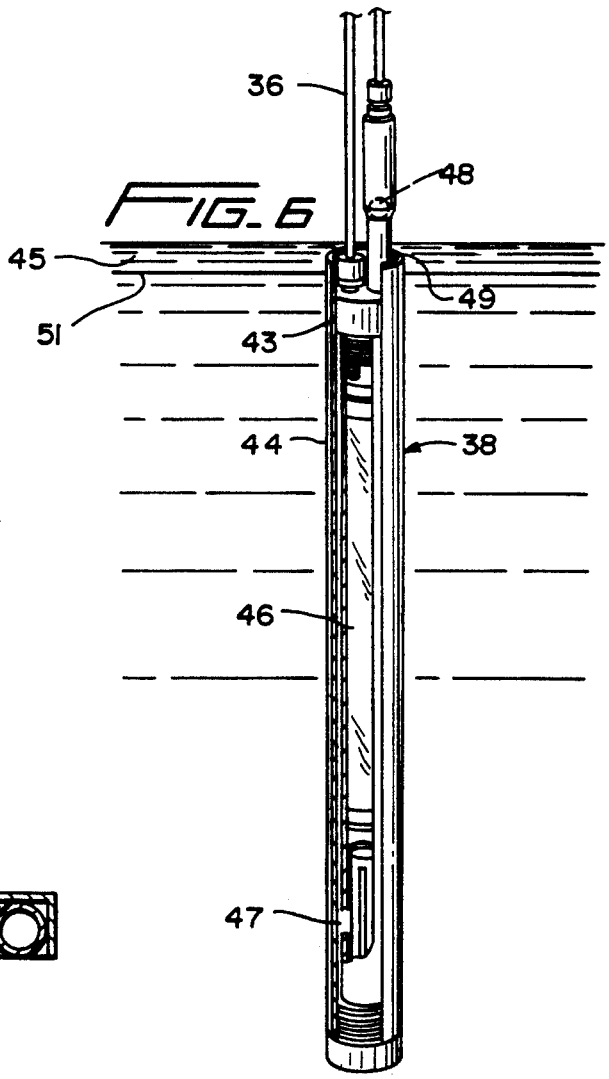
FIG. 6 is a perspective view of a bladder pump, with portions shown broken away and in cross-section that utilizes the pressure and vacuum generated by the system shown in FIG. 1.
Figure 4:
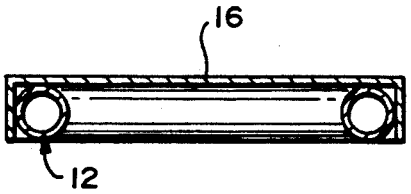
FIG. 4 is a cross-sectional view taken across the structural member and platform of a cart used in the present invention.

The pump 38, as best shown in FIG. 6, comprises an outer casing 43, an intermediate casing 44 and an interior bladder 46 of resilient material. In operation, a floating layer 45 of liquid over a body of water 51 enters the bladder pump 38 through openings 49 at the top of the outer casing 43 and through a lower inlet poppet valve 47 by means of the application of a vacuum from the device R, causing the bladder 46 to collapse. The liquid collects between the intermediate casing 44 and the bladder 46. Application of pressurized air to the bladder 46 causes it to expand, thus applying pressure to the liquid in the pump body. This in turn closes the lower inlet poppet valve 47 and forces the contents of the pump up through the sample line ball check 48. Venting the bladder 46 by application of vacuum through the line 36 allows the pump to refill. The bladder 46 collapses fully during the vacuum cycle, allowing the pump maximum fill.

Figure 3:
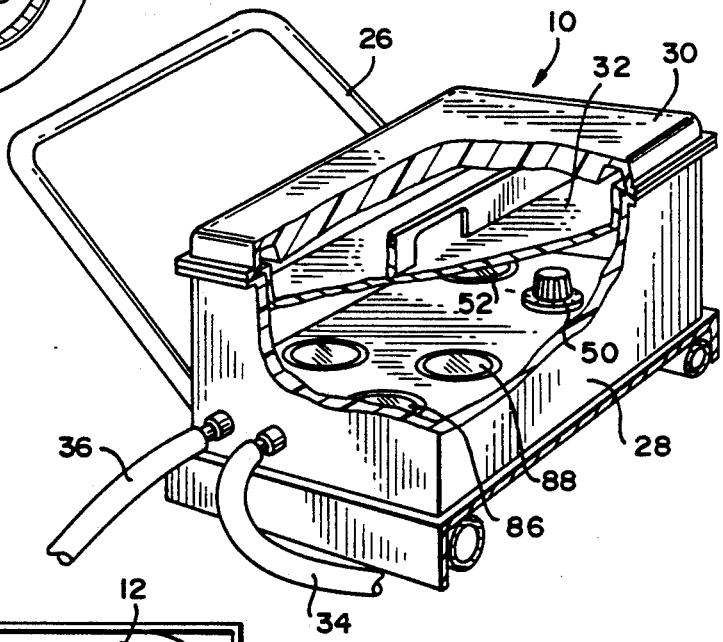
FIG. 3 is a perspective cross-sectional view, with portions broken away to show the interior of a controller used in accordance with the present invention.

The controller 10, as best shown in FIG. 3, includes a timer selector switch 50, which will be described below, and a plurality of gauges 52.

The controller 10 includes an electrically operated three-way air valve 54 connected to the hose 34, which is operably connected to the compressed air within the support member 12. A pressure line 56 connects the valve 54 to another electrically operated three-way air valve 58. A pressure line 60 connects the air valve 54 to a venturi device 62. A vacuum line 64 connects the venturi device 62 to the air valve 58. A timer circuit 66 operates the air valves 54 and 58 in a manner to be described below. The valve 54 is used to direct the pressurized air to either the venturi device 62 or the valve 58. The venturi device 62 converts the pressurized air to a vacuum. The valve 58 directs either compressed air from the valve 54 through the pressure line 56, or a vacuum from the venturi device 62 through the vacuum line 64 and thence to the bladder pump 38.

A pressure regulator 68 and a pressure gauge 72 operate upon the outgoing compressed air to the bladder pump 38. A filter 73 may be incorporated into the input line 34 to prevent dirt particles and condensation from interfering with the operation of the venturi device 62 and the air valves 54 and 58. Visual lamp indicators 74 display the operational status—pressure or vacuum—of the controller 10.

Figure 7:
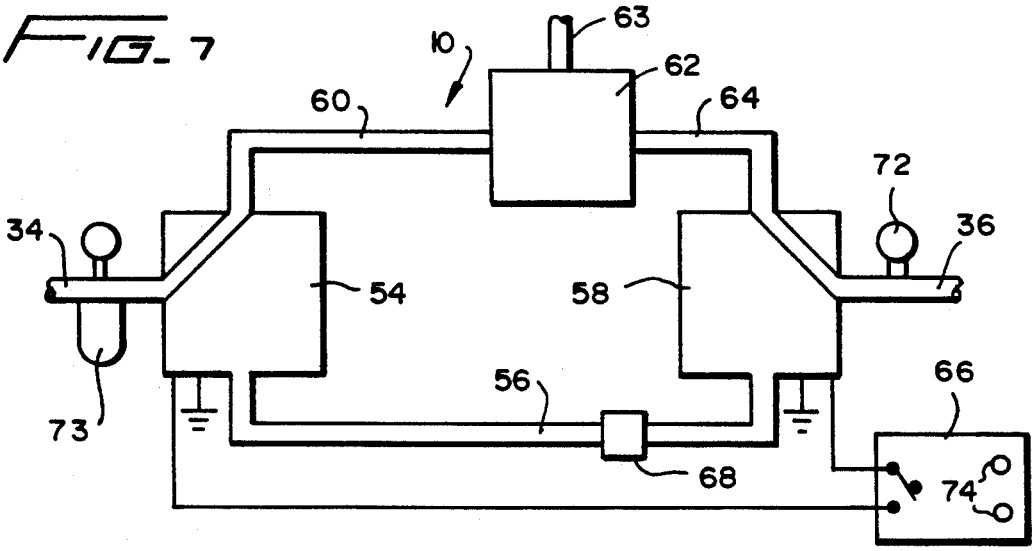
FIG. 7 is a schematic view of a controller according to the present invention shown in a vacuum mode.
Figure 8:
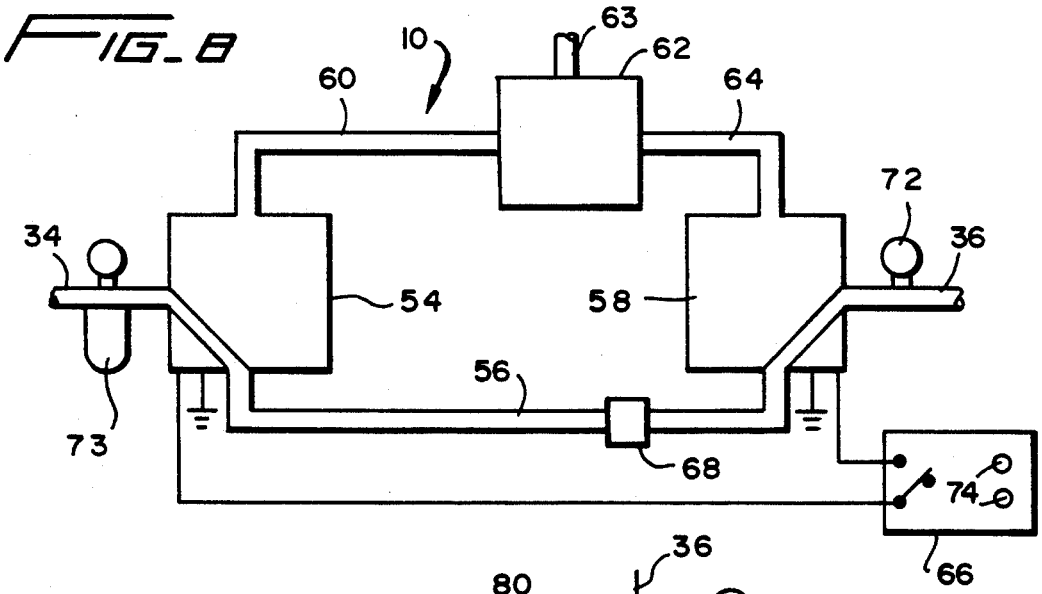
FIG. 8 is a schematic view of a controller according to the present invention shown in a pressure mode.

The air valves 54 and 58 have a first position whereby pressurized air generated by the compressor is directed to the venturi device 62 via the pressure line 60 and through exhaust 63 to generate a vacuum through lines 64 and 36, as best shown in FIG. 7. The air valves 54 and 58 have a second position in which the incoming pressurized air through line 34 is supplied through line 56 and 36 and thence to the bladder pump 38, as best shown in FIG. 8. The timer circuit 66 operates the valves 54 and 58 in such a way that the valves are either in their first positions, as best shown in FIG. 7, or in their second positions, as best shown in FIG. 8, for preselected periods.

Figure 9:
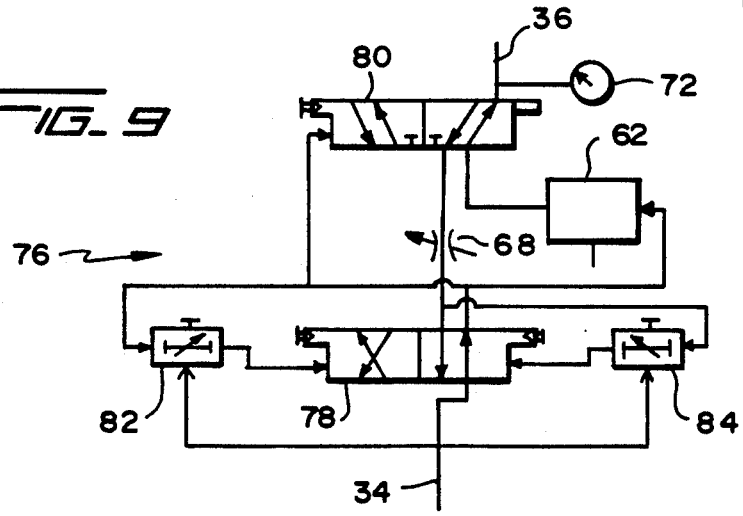
FIG. 9 is a schematic diagram of another embodiment of a controller according to the present invention.

A controller 76 is disclosed in FIG. 9 as a pneumatic version of the controller 10. Multi-way air pilot operated air valves 78 and 80 are used in place of the electrically operated valves 54 and 58. Pneumatically operated time delay relays 82 and 84 replace the electric timer circuit 66. The pneumatic relays 82 and 84 provide user selectable vacuum and pressure cycle time. The switching of the incoming compressed air from line 34 to the inground bladder pump 38 or the venturi device 62 is accomplished with the pneumatic air valves 78 and 80. Dial controls 86 and 88, as best shown in FIG. 3, are operably connected to respective pneumatic time delay relays 82 and 84, and provide selectable vacuum and pressure cycle times.

Figure 10:
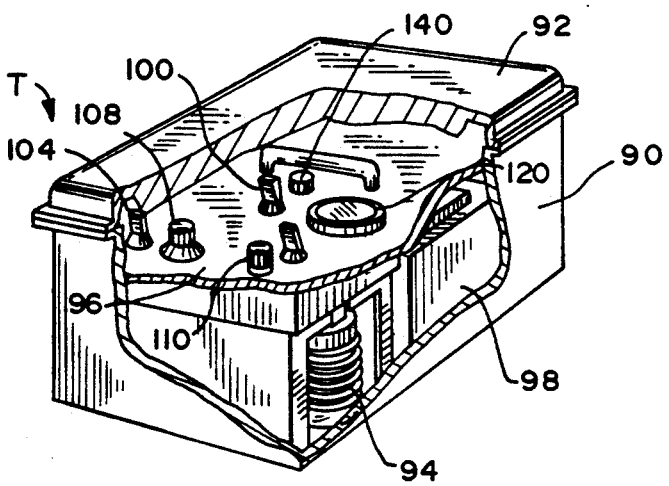
FIG. 10 is a perspective view, with portions broken away, of an alternative embodiment of an integrated pressure vacuum system in accordance with the present invention.
Figure 11:
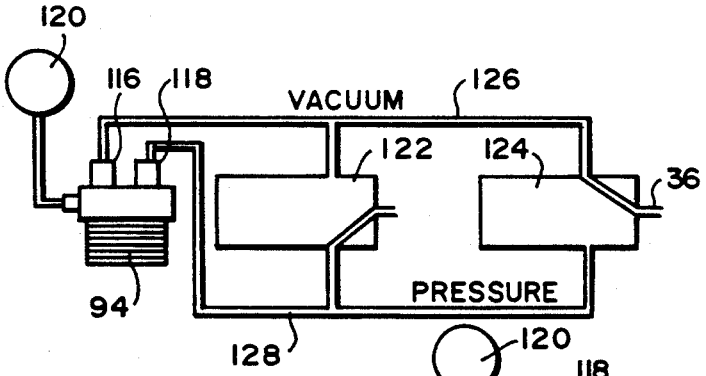
FIG. 11 is a schematic diagram of the system of FIG. 10 shown in a vacuum mode.
Figure 12:
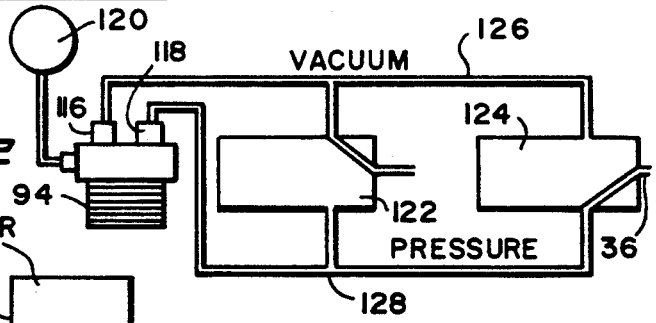
FIG. 12 is a schematic diagram of the system of FIG. 11 shown in a pressure mode.
Figure 13:
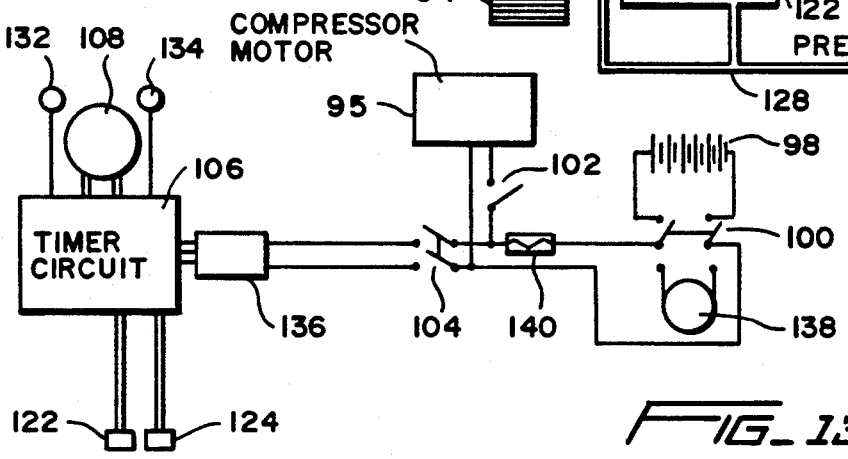
FIG. 13 is a schematic block diagram of the system shown in FIG. 10, showing a timer circuit for switching the output of a compressor between pressure and vacuum.

An integrated pressure vacuum assembly T, as best shown in FIG. 10 is an alternative embodiment of the assembly R. The assembly T includes a housing 90 with an openable cover 92. An air compressor 94 with a battery operated electric motor 95 operably connected thereto, as best shown in FIG. 13, is secured to a removable control panel 96, which is disposed within the housing 90. A battery 98 operably connected to the compressor 94 is disposed underneath the panel 96 within the housing 90 and adjacent to the compressor 94. The battery 98 is switched on and off by a main power switch 100. A switch 102 connects the compressor 94 to the battery 98 when the switch 100 is closed. A switch 104 connects a timer circuit 106 to the power source. A cycle selector switch 108 provides a user the means to select the cycling times for pressure or vacuum. A vacuum/pressure fitting 110 connects to a hose (not shown), which is connected to the bladder pump 38.

The air compressor 94 is a piston/cylinder type compressor. It has a removable steel sleeve cylinder and a ringed piston. The cylinder head is provided with an intake poppet valve 116 and an outlet poppet valve 118. A pressure gauge 120, connected to a chamber within the cylinder head, is used as a vacuum/pressure indicator.

Battery operated air valves 122 and 124 direct either vacuum through line 126 or pressure through line 128 to the bladder pump 38. The valves 122 and 124 are controlled in a flip flop arrangement by the timer circuit 106.

The timer circuit 106 provides an adjustable time for bladder pressurization, an adjustable time for bladder evacuation, and a sequencing of these two functions. The cycle selector switch 108 provides a number of preset vacuum/pressure cycle times. In the embodiment of the assembly T, the selector switch 108 is a multiposition rotary switch, with each position corresponding to a preset independent pressure and vacuum cycle times. Indicator lamp 132 and 134 indicate the status of the timer circuit. A regulator 136 takes the output of a 12 volt battery 98 and steps it down to 5 volts. The step down supply ensures that the timer circuits are not adversely altered by changes in voltage from the battery 98.

An external battery source 138 may be connected to the timer circuit and the compressor motor through the selector switch 100. A fuse 140 provides overcurrent protection for the compressor motor and the timer circuit.

Figure 14:
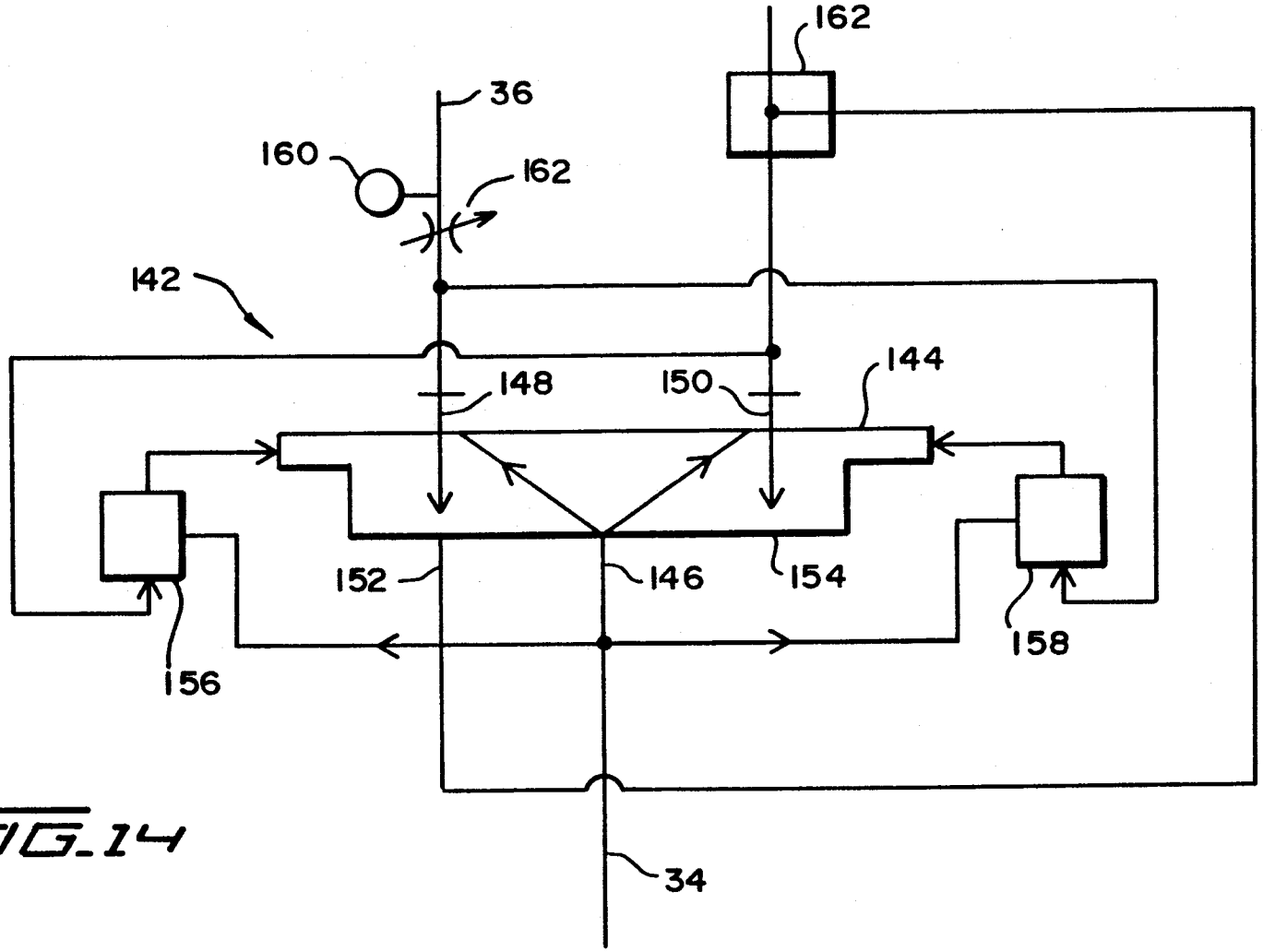
FIG. 14 is a schematic diagram of another embodiment of a controller according to the present invention.

A controller 142 is disclosed in FIG. 14 as another version of the controller 10. A double pilot air valve 144 has inlet 146, outlets 148 and 150, and exhausts 152 and 154. The inlet 146 is operably connected to the compressed air source hose 34 and the outlets 148 and 150 to the pump hose 36 and the Venturi device 62, respectively. Pneumatic vent timer 156 and pressure timer 158 are operably connected to the valve 144. A pressure gauge 160 and a regulator 162 are operatively connected to the outlet 148.

The inlet 146 is connected to only one of the outlets 148 and 150 at any one time. When the inlet 146 is connected to the outlet 148, compressed air is provided to the pump 38 and the timer 158 is energized. At the end of a preset time, the valve 144 is actuated such that the inlet 146 is then connected to the outlet 150, which is connected to the Venturi device 162. At this time, the outlet 148 is connected to the exhaust 152. The timer 156 is then energized and permits the venting of the pump 38 for a preset period. At the end of the period, the inlet 146 is again switched to the outlet 148 to start the whole sequence again.

OPERATION

The operation of the assembly R will now be described. After assembly R is positioned in place adjacent to the well 40, the hose 36 is hooked up to the bladder pump 38. The recovery hose 42 is also connected to the pump. The pump 38 is then lowered into the well 40 to the desired depth. The selector switch 50 is turned to a desired position which corresponds to a specific pressurization and vacuum cycle time. As an example, the table below shows the various pressure and vent/vacuum times for each position of the selector switch 50.

| | Switch Position | | | | |
|---|---|---|---|---|---|
| | 1 | 2 | 3 | 4 | 5 |
| Pressure Time (secs) | 3 | 5 | 8 | 12 | 15 |
| Vent/Vacuum Time (secs) | 4 | 7 | 13 | 19 | 25 |
| Cycle Time (secs) | 7 | 12 | 21 | 31 | 40 |

The engine 6 is started to drive the compressor 4. Compressed air is then permitted to build up to a certain level within the structural member 12. The compressed air is typically in the range of 40 psi to 100 psi in order to drive the venturi device 62 and the pump 38.

During presentation time, the timer circuit 66 configures the air valves 54 and 58 into their second positions or pressure mode such that pressurized air is directed to the pump 38, as best shown in FIG. 8. The timer circuit keeps the valves in this configuration for a preselected period.

At the end of the period, the timer circuit reconfigures the valves 54 and 58 into their first positions or vacuum mode such that pressurized air is directed to the venturi device 62 and exhausted through exhaust 63, thereby creating vacuum in the line 64 and in the pump 38, as best shown in FIG. 7. The timer circuit maintains the valves in the vacuum mode during a preselected period. At the end of the vacuum mode period, the timer circuit will reconfigure the valves to the pressure mode and the entire cycle is repeated. Thus, the bladder pump will alternately experience pressurization and venting for preselected periods.

A person skilled in the art will understand that valves 54 and 58 are electrically operated and can be effectively controlled by the timer circuit 66.

The operation of the controller 76 is similar to the operation of the controller 10, except that the valves and timers are pneumatically controlled.

The rate of air usage will vary depending upon the user's settings of the timer circuit, the pump depth tot he water level and amount of submergence, operating air pressure, and size and length of the lines used to connect the bladder pump to the controller, and the like. The timer circuit 66 and the valves 54 and 58 use a 12 volt battery.

The operation of the assembly T is similar to the operation of the assembly R. The user preselects the pressurization and vent/vacuum cycles by means of the selector switch 108. As in the assembly R, the selector switch 108 has multiple positions, each of which corresponds to the cycle times.

The timer circuit 106 determines the vacuum and pressure cycle times. During a vacuum cycle, the air valve 124 is open to the inlet valve 116 and closed to the outlet valve 118 of the compressor 94. Likewise, the valve 122 is closed to the inlet valve 116 and open to the outlet valve 118. During the suction cycle of the compressor 94, the inlet valve 116 is open and the outlet valve 118 is closed. This causes vacuum to be created in the line 126, which is connected to the bladder pump 38, to thereby cause the bladder 46 in the pump 38 to collapse. During the compression cycle of the compressor, the valve 116 is closed and the valve 118 is opened, thereby exhausting the compressed air through the valve 122 and into the atmosphere.

During a pressurization cycle, the valve 124 is open to the outlet valve 118 and closed to the valve 116. Likewise, the valve 122 is closed to the valve 118 and open to the valve 116. During the compression cycle of the compressor, valve 118 is open and valve 116 is closed, thereby creating pressurized air in the line 128 that is transmitted to the bladder pump through the valve 124 and the line 36. This causes the bladder 46 to expand. During the suction cycle, the valve 116 is open while the valve 118 is closed, thereby permitting air to be drawn from the atmosphere through the valve 122.

During the pressurization and vacuum cycles, respective LED lamps 132 and 134 are lit to indicate the status of the compressor.

While this invention has been described as having preferred design, it is understood that it is capable of further modification, uses and/or adaptations of the invention following in general the principle of the invention and including such departures from the present disclosure as come within known or customary practice in the art to which the invention pertains, and as may be applied to the essential features set forth, and fall within the scope of the invention or the limits of the appended claims.

I claim:

1. An apparatus for driving a sampling pump disposed in a monitoring well, said apparatus comprising:

a) a structural support member including a container for pressurized gas, said support member having a first and second tubular portions, said second tubular portion extending away from said first tubular portion;

b) a platform supported by said structural member, said platform having length, width and a top surface, said platform being disposed on top of said structural support member and secured thereto, said structural support member first and second tubular portions spanning the length and width of said platform, respectively, thereby to provide support thereto;

c) means for generating pressurized gas secured on said top surface and operably connected to said container;

d) means for generating a vacuum from the pressurized gas in said container; and e) a controller carried by said platform and operably connected to said container and said vacuum generating means and a sampling pump for alternatively directing compressed gas and vacuum to the pump to thereby operate the pump.

2. An apparatus as in claim 1, and including:

a) means operably associated with said platform for moving said platform.

3. An apparatus as in claim 2, and including:

a) support means disposed away from said moving means for permitting said platform to rest in a stable position.

4. An apparatus as in claim 2, wherein:

a) said moving means includes an axle and a pair of wheels operably connected thereto; and b) said axle is connected to said support member.

5. An apparatus as in claim 3, and including:

a) means for detachably securing said moving means and said support means to said platform.

6. An apparatus as in claim 1, wherein:

a) said member is tubular; and b) said member includes at least a U-shaped portion.

7. An apparatus as in claim 6, wherein:

a) said member has a circular cross-section.

8. An apparatus as in claim 1, wherein:

a) said vacuum generating means is a venturi device.

9. An apparatus as in claim 8, wherein:

a) said controller comprises first and second three-way valves.

10. An apparatus as in claim 9, wherein:

a) said first valve is operably connected to said pressurized gas container, said first valve having a first position and a second position;

b) said first valve first position is operably connected to said venturi device;

c) said second valve is operably connected to the sampling pump, said second valve having first and second positions;

d) said second valve first position is operably connected to said venturi device such that vacuum is supplied to the pump when said first valve is in said first position;

e) said second valve second position is operably connected to said first valve second position such that pressurized gas is supplied to the pump when said first valve is in said second position; and f) said controller includes timer means operably connected to said first and second valves to remain in their respective first first and second valves to remain in their respective first positions for a preselected time thereby to provide vacuum to the pump and in their respective second positions thereby to provide pressurized gas to the pump.

11. An apparatus as in claim 10, wherein:

a) said first and second valves are electrically actuated.

12. An apparatus as in claim 10, wherein:

a) said first and second valves are pneumatic.

13. An apparatus as in claim 11, wherein:

a) said timer is electric.

14. An apparatus as in claim 12, wherein:

a) said timer is pneumatic.

15. An apparatus as in claim 1, wherein:

a) said controller comprises a double pilot air valve having an inlet connected to said pressurized gas generating means, a first outlet operably connected to the pump, a second outlet operably connected to said vacuum generating means, and an exhaust connected to said vacuum generating means;

b) said inlet is selectively connectable to said first outlet in said valve, thereby to provide pressurized gas to the pump;

c) said inlet is selectively connectable to said second outlet thereby to supply pressurized gas to said vacuum generating means; and d) said first outlet is connected in said valve to said exhaust when said inlet is connected in said valve to said second outlet, thereby to generate vacuum in the pump.

16. An apparatus as in claim 15, wherein:

a) said controller includes timer means operably connected to said valve for controlling the position of said inlet relative to said first and second outlets.

17. An apparatus for driving a sampling pump disposed in a monitoring well, said apparatus comprising:

a) a reciprocating piston/cylinder compressor;

b) said compressor having a pressure outlet for exhausting compressed air and a suction inlet for sucking in air into said compressor;

c) means for automatically connecting said outlet and said inlet each for a preselected time to a sampling pump, thereby alternately providing compressed air and vacuum to the pump;

d) first and second three-way air valves operably connected to said compressor and the pump;

e) said first valve is connected to said inlet and outlet of said compressor and communicates with the atmosphere;

f) said second valve is connected to said inlet and outlet of said compressor and to the sampling pump;

g) said first valve is open to said inlet and closed to said outlet and said second valve is closed to said inlet and open to said outlet during a pressure cycle, thereby causing pressurized air from said compressor to be delivered to the pump; and h) said first valve is open to said outlet and closed to said inlet and said second valve is open to said inlet and closed to said outlet during a vacuum cycle, thereby causing vacuum to be created within the pump.

18. An apparatus as in claim 17, and including:

a) means for connecting to an external battery.

19. An apparatus as in claim 17, and including:

a) a housing; and b) said compressor and connecting means are disposed in said housing.

20. An apparatus as in claim 17, wherein:

a) said first and second air valves are electric.

* * * * *